US012760488B2

(12) United States Patent
Zock

(10) Patent No.: US 12,760,488 B2
(45) Date of Patent: Oct. 13, 2026

(54) WOVEN GEOTEXTILE SILT FENCE WITH STABILIZING FEATURES FOR TRENCH OR TRENCHLESS INSTALLATIONS

(71) Applicant: BLUROCK INVESTMENTS, LLC, Saxonburg, PA (US)

(72) Inventor: Michael A. Zock, Saxonburg, PA (US)

(73) Assignee: BLUROCK INVESTMENTS, LLC, Saxonburg, PA (US)

( * ) Notice: Subject to any disclaimer, the term of this patent is extended or adjusted under 35 U.S.C. 154(b) by 32 days.

(21) Appl. No.: 18/899,476

(22) Filed: Sep. 27, 2024

(65) Prior Publication Data

US 2025/0101702 A1 Mar. 27, 2025

Related U.S. Application Data

(60) Provisional application No. 63/540,864, filed on Sep. 27, 2023.

(51) Int. Cl.
*E02D 17/20* (2006.01)

(52) U.S. Cl.
CPC ..... *E02D 17/202* (2013.01)

(58) Field of Classification Search
CPC ..... E02D 17/20; E02D 17/202
See application file for complete search history.

(56) References Cited

U.S. PATENT DOCUMENTS 4,279,535 A * 7/1981 Gagliardi ..... E02B 3/12 405/32
5,108,224 A * 4/1992 Cabaniss ..... D03D 9/00 405/15
5,605,416 A * 2/1997 Roach ..... E02B 3/02 405/32
7,465,129 B2 * 12/2008 Singleton ..... E02D 17/20 428/221
8,100,609 B2 * 1/2012 Wilson ..... E02B 3/04 405/15

(Continued)

OTHER PUBLICATIONS

Stevens, Ellen; Barfield, Billy J.; Britton, S.L.; Hayes, J.S. (Sep. 2004). Filter Fence Design Aid for Sediment Control at Construction Sites (Report). Cincinnati, OH: U.S. Environmental Protection Agency (EPA).

(Continued)

*Primary Examiner* — Frederick L Lagman
(74) *Attorney, Agent, or Firm* — Blynn L. Shideler; Krisanne Shideler; BLK Law Group

(57) ABSTRACT

A silt fence for erosion, sediment and pollution control includes plurality of spaced wooded or metal stakes; a woven geotextile silt fence fabric comprising one of i) polyester yarn with a PVC coating or ii) high tenacity polypropylene yarn; and at least one stabilizing feature in the form of at least one of i) a top drawstring coupled to a top edge of the woven geotextile silt fence fabric and ii) stabilizing fins coupled to at least some of the stakes. A trenchless method of installing the silt fence comprises: providing a silt fence bundle comprising a plurality of spaced stakes and a geotextile silt fence fabric coupled to the stakes and including an integral ground engaging apron; driving the plurality of spaced stakes into the ground until the integral ground engaging apron is flush with the ground; and staking the ground engaging apron to the ground with staking elements.

20 Claims, 6 Drawing Sheets

(56) References Cited

U.S. PATENT DOCUMENTS

| | | | | |
|---|---|---|---|---|
| 8,596,930 | B2 * | 12/2013 | Woudenberg | E02D 17/202 405/302.6 |
| 8,747,027 | B1 * | 6/2014 | Singleton | E02D 3/005 405/302.6 |
| 10,145,080 | B2 * | 12/2018 | Segroves | E02D 17/202 |
| 11,466,413 | B2 * | 10/2022 | Zock | E01F 7/02 |
| 11,634,880 | B2 * | 4/2023 | Segroves | D03D 15/43 256/12.5 |
| 2006/0133897 | A1 * | 6/2006 | Allard | E02B 11/005 405/36 |
| 2007/0217871 | A1 * | 9/2007 | Kerman | E02D 17/20 405/302.6 |
| 2007/0280789 | A1 * | 12/2007 | Mason | E02B 3/04 405/302.6 |
| 2019/0176059 | A1 * | 6/2019 | Zock | E02B 3/125 |
| 2019/0203434 | A1 * | 7/2019 | Segroves | E01F 7/02 |
| 2019/0264414 | A1 * | 8/2019 | Gregory, II | C02F 1/004 |
| 2020/0370251 | A1 * | 11/2020 | Zock | D04H 3/102 |
| 2023/0035252 | A1 * | 2/2023 | Singleton | E02B 3/04 |

OTHER PUBLICATIONS

"Chapter 2. Erosion and Sediment Control Principles, Practices and Costs" (PDF). Virginia Erosion and Sediment Control Handbook (Report) (3rd Ed.). Richmond, VA: Virginia Department of Environmental Quality (VA DEQ). 1992.

Silt Fences (PDF) (Report). Stormwater Best Management Practice. Washington, D.C.: EPA. 2012. EPA 833-F-11-008.

Brzozowski, Carol (Nov.-Dec. 2006). "Silt Fence Installation". Erosion Control. Forester Media. 13 (7).

* cited by examiner

FIG. 8
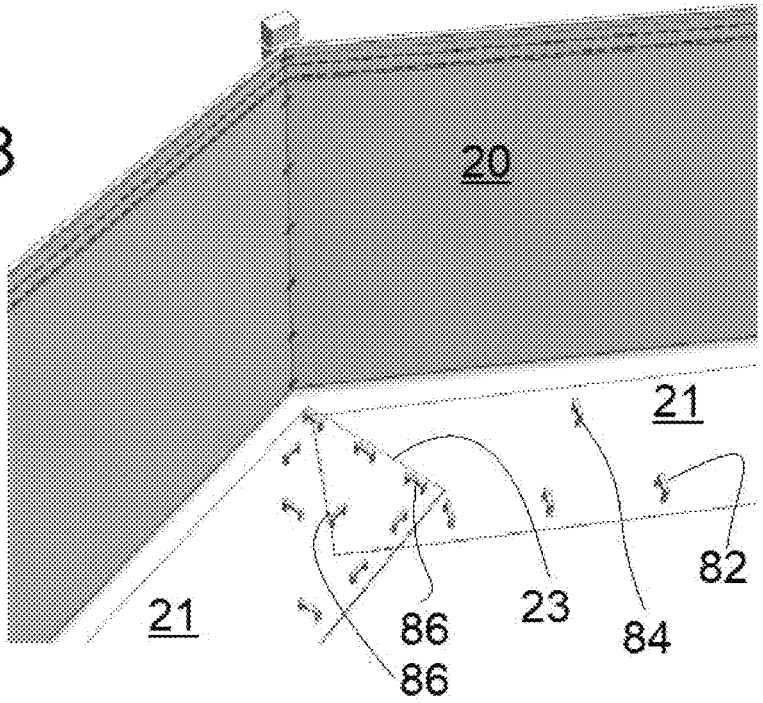
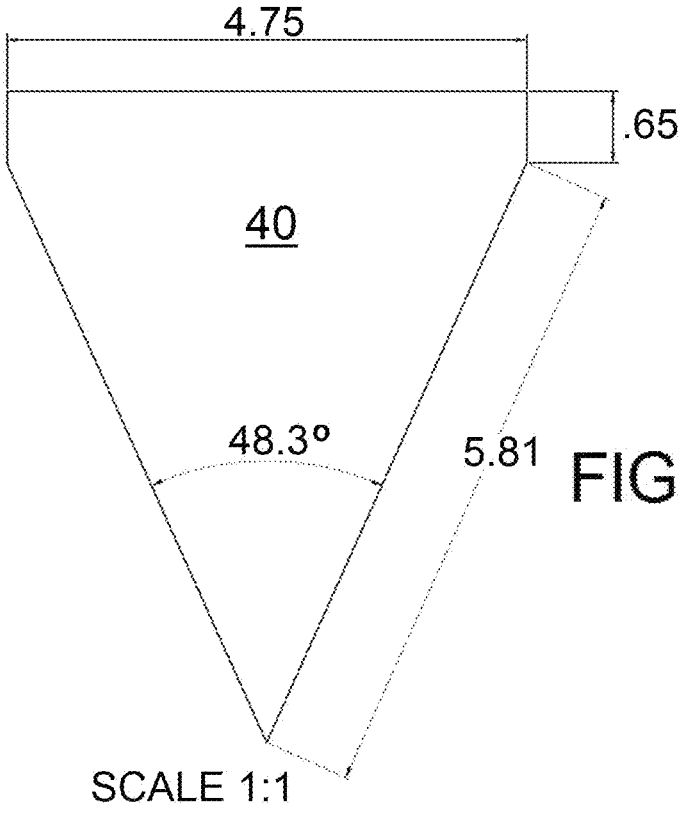
FIG. 10

WOVEN GEOTEXTILE SILT FENCE WITH STABILIZING FEATURES FOR TRENCH OR TRENCHLESS INSTALLATIONS

RELATED APPLICATIONS

This application claims priority to U.S. provisional patent application Ser. No. 63/540,864 filed Sep. 27, 2024, titled "Woven Geotextile Silt Fence with Stabilizing Features" which application is incorporated herein by reference in its entirety.

BACKGROUND INFORMATION

1. Field of the Invention

The present invention relates to a silt fence and more particular to woven geotextile silt fences with stabilizing features, more particularly to a woven geotextile silt fence with top drawstring. The present invention is also directed to a method of installing trench silt fence stake reinforcing element and a method of installing a trenchless silt fence.

2. Background Information

The present invention relates to the general and overlapping fields of erosion, sediment and pollution control. Erosion control, broadly, is the practice of preventing or controlling wind or water erosion in agriculture, land development, coastal areas, river banks and construction. Effective erosion controls handle surface runoff and are important techniques in preventing water pollution, soil loss, wildlife habitat loss and human property loss. Sediment control is a practice designed to keep eroded soil on a construction site, so that it does not wash off and cause water pollution to a nearby stream, river, lake, or sea. Sediment controls are usually employed together with erosion controls, which are designed to prevent or minimize erosion and thus reduce the need for sediment controls. Sediment controls are generally designed to be temporary measures, however, some can be used for storm water management purposes. Pollution control, in this context, is the removal or limiting of specific contaminants within surface waters, and pollution control devices may be implemented with or integrated within erosion and sediment control devices.

A silt fence is a temporary sediment control device used on construction sites configured to protect water quality in nearby streams, rivers, lakes and seas from sediment (loose soil) in stormwater runoff. Silt fences are widely used on construction sites in North America and elsewhere, due to their low cost and simple design. See Stevens, Ellen; Barfield, Billy J.; Britton, S. L.; Hayes, J. S. (September 2004). Filter Fence Design Aid for Sediment Control at Construction Sites (Report). Cincinnati, OH: U.S. Environmental Protection Agency (EPA).

A silt fence is often installed as a perimeter control, i.e. around a perimeter of an area of interest. Silt fences are often used in combination with sediment basins and sediment traps, as well as with erosion controls, which are designed to retain sediment in place where soil is being disturbed by construction processes (i.e., land grading and other earthworks). See "Chapter 2. Erosion and Sediment Control Principles, Practices and Costs" (PDF). Virginia Erosion and Sediment Control Handbook (Report) (3rd Ed.). Richmond, VA: Virginia Department of Environmental Quality (VA DEQ). 1992.

A typical silt fence consists of a piece of synthetic filter fabric, also called a geotextile, stretched between a series of wooden or metal fence stakes along a horizontal contour level. The stakes are typically installed on the downhill side of the silt fence, and the bottom edge of the fabric is trenched into the soil and backfilled on the uphill side. The design/placement of the silt fence should create a pooling of runoff, which then allows sedimentation to occur. Water can seep through the silt fence fabric, but the fabric often becomes "blocked off" or "blinded" with fine soil particles (all sediment-retention devices have this challenge, and none of them "filter" storm water for very long). A few hours after a storm event, the fabric can be "disturbed" in order to dislodge the fines, and allow clean water to flow through. Depending on the protected watershed and erosion, larger soil particles will settle out, ultimately filling the silt fence to the top of the structure; requiring another silt fence above or below it (creating a new ponding area), or for the silt fence to be removed, the sediment removed or spread out, and a new fence installed. A typical silt fence is not designed to concentrate or channel stormwater and typically is installed on a site before soil disturbance begins, and is placed down-slope from the disturbance area. See Silt Fences (PDF) (Report). Stormwater Best Management Practice. Washington, D.C.: EPA. 2012. EPA 833-F-11-008.

Silt fence fabrics (geotextiles) tested in laboratory settings have shown to be effective at trapping sediment particles. However, some field tests of silt fences installed at construction sites, have shown generally poorer results. In these studies, effectiveness testing involved measurements for both total suspended solids and turbidity. Other studies and articles about silt fence usage and practice document problems with installation and maintenance, implying poor performance. Since at least the year 2000, static slicing the material into the ground has been widely adopted. In 2000, the U.S. Environmental Protection Agency (EPA) co-sponsored silt fence efficacy field research through its Environmental Technology Verification Program, and in general, the report found the static slicing method to be highly effective, and efficient. It has been proposed by some that silt fence effectiveness is best determined by how many hundreds of pounds of sediment are contained behind a given silt fence after a storm event, and not turbidity, etc. as sediment-retention is the end goal, and not a water-quality measurement used in erosion control, for instance.

Silt fences may perform poorly for a variety of reasons, including improper location (e.g. placing fence where it will not pond runoff water), improper installation (e.g. failure to adequately embed and backfill the lower edge of fabric in the soil) and lack of maintenance—fabric falling off of the posts, or posts knocked down. During various phases of construction at a site, a silt fence may be removed relocated and reinstalled multiple times. See Brzozowski, Carol (November-December 2006). "Silt Fence Installation". *Erosion Control*. Forester Media. 13 (7).

It is one object of the present invention to provide a woven silt fence with stabilizing features for simplified improved performance.

SUMMARY OF THE INVENTION

One aspect of this invention is directed to a cost effective, efficient, and easy to implement woven geotextile silt fence with top drawstring and trench engaging stabilizing fins with bury depth indicator.

One aspect of the present invention is directed toward A silt fence for erosion, sediment and pollution control includes plurality of spaced wooded or metal stakes; a woven geotextile silt fence fabric comprising one of i) polyester yarn with a PVC coating or ii) high tenacity polypropylene yarn; and at least one stabilizing feature in the form of at least one of i) a top drawstring coupled to a top edge of the woven geotextile silt fence fabric and ii) stabilizing fins coupled to at least some of the stakes.

One aspect of the present invention provides a trenchless method of installing a silt fence for erosion, sediment and pollution control, comprising the steps of: providing a silt fence bundle comprising a plurality of spaced wooded or metal stakes and a geotextile silt fence fabric coupled to the spaced wooded or metal stakes and including an integral ground engaging apron; driving the plurality of spaced wooded or metal stakes into the ground until the integral ground engaging apron is flush with the ground; and staking the ground engaging apron to the ground with staking elements.

One aspect of the invention provides a method of installing a silt fence for erosion, sediment and pollution control comprising the steps of: providing a geotextile coupled to a plurality of stakes, with a plurality of stakes including trench engaging stabilizing fins, and each stabilizing fin including with a bury depth indicator; digging a trench that is deeper than the length of the trench engaging fins; placing the silt fence with the trench engaging stabilizing fins within the trench to the height of the bury depth indicator; filling the trench to install the silt fence.

These and other aspects of the present invention will be clarified in the description of the preferred embodiment of the present invention described below in connection with the attached figures in which like reference numerals represent like elements throughout.

DESCRIPTION OF THE FIGURES

FIG. 8 is a perspective schematic view of an inside corner formed with the trenchless installation method according to one embodiment of the present invention.

FIG. 10 is a plan view of a plate forming stabilizing fins for the stakes of the present invention.

DESCRIPTION OF THE PREFERRED EMBODIMENTS

Figure 1:
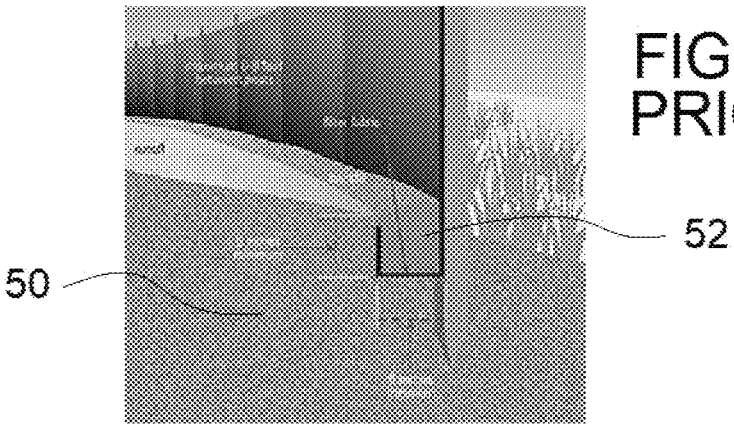
FIG. 1 PRIOR ART
FIG. 1 is a perspective schematic view of a prior art trenched silt fence.
Figure 2:
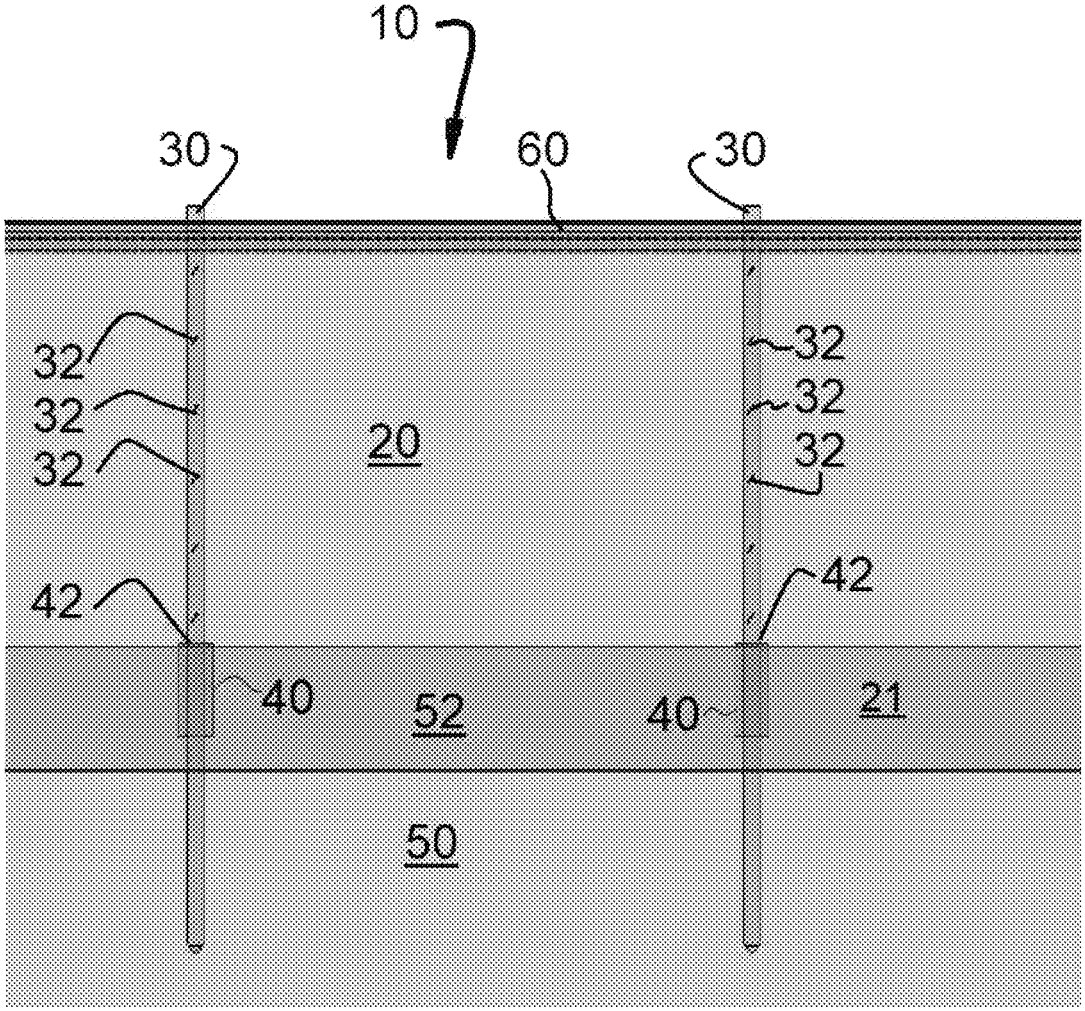
FIG. 2 is an elevated schematic view of a woven geotextile silt fence with stabilizing features according to one embodiment of the invention.
Figure 3:
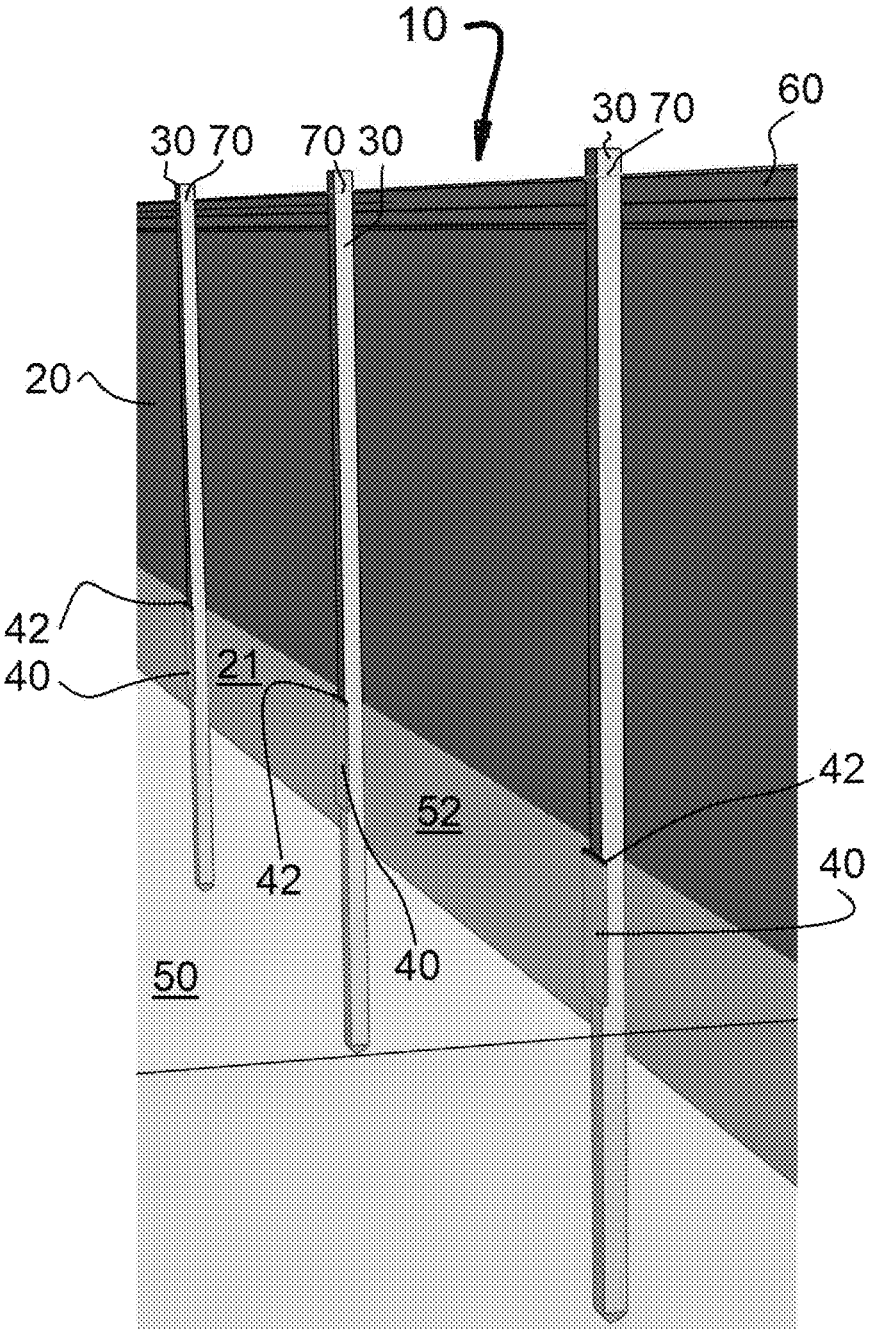
FIG. 3 is a rear perspective schematic view of the woven geotextile silt fence with stabilizing features according to one embodiment of the invention.
Figure 4:
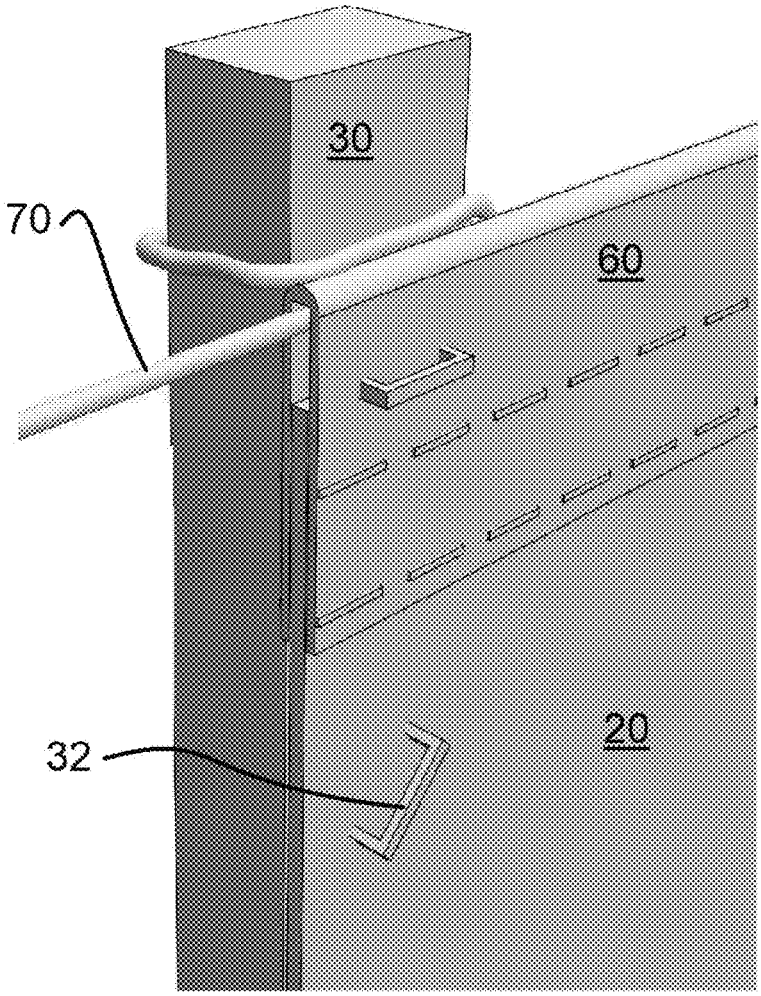
FIG. 4 is an enlarged schematic perspective view of the woven geotextile silt fence with stabilizing features according to one embodiment of the invention with a portion of the silt fence removed for clarity.

The present invention is directed to a woven geotextile silt fence 10, shown in FIGS. 2-4 with stabilizing features in the form of a top drawstring 70 and a trench engaging stabilizing fins (formed by plate 40) with bury depth indicator 42 for trench implementations. The silt fence 10 will include a woven geotextile 20 coupled to stakes 30 by fasteners or stapes 32 or the like, with the stakes 30 provided at regular intervals such as 4' or 5' intervals. Where the stakes 30 are wood, ¼"×1" staples are effective as fasteners 32. Where the stakes 30 are metal posts, such as T-posts shown in FIG. 7, wire ties or zip ties may be used for fasteners 32.

Woven Geotextile 20

Figure 5:
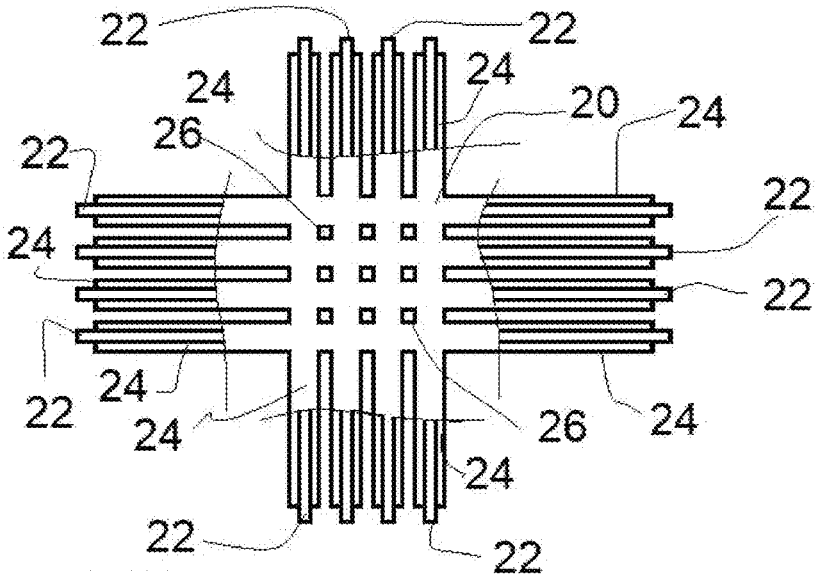
FIG. 5 is a schematic enlarged plan view of a portion of a woven geotextile formed from multifilament polyester yarn and PVC coating for forming the fence according to one embodiment of the present invention.

A suitable woven geotextile 20 is a woven multifilament polyester yarn 22 with a PVC coating 24. The polyester yarns 22 are woven in a conventional fashion and then coated with a PVC coating 24 leaving mesh openings 26. FIG. 5 schematically shows an enlarged version of a portion of the geotextile 20 (generally the center) with a 4×4 matrix of horizontal and vertical multifilament polyester yarns 22. Outside of the central area the horizontal and vertical multifilament polyester yarns 22 are shown in cross section and with the woven threads omitted for clarity showing the coating 24 on the yarn 22. The yarn 22 are schematically shown extending beyond the coating 24 solely to highlight the difference between the elements. In actuality the geotextile will resemble the matrix shown in the center of FIG. 4 with yarn 22 covered with coating 24. The PVC coating 24 locks the multifilament polyester yarns 22 together preventing movement of the filament yarns 22, or fraying of the yarn 22.

The PVC coating 24 allows for color control for branding of the fence 10, or for high visibility of the fence 10, or both. Specifically the PVC coating 24 with hi-vis coloring visibly demonstrates a higher visibility color and brightness, i. e., a more vivid appearance, than conventional hi-vis silt fence fabrics. In certain examples, it exhibits at least 10% higher values for at least one of HGB, LSV, and Delta E than conventional hi-vis silt fence fabrics formed of polypropylene.

The PVC coating 24 may include additives, such as UV resistant additives, and surface modifiers. The thickness of the coating 24 may be selected and varied for defining and or controlling the sieve size and associated flow rate through the textile 20. Multiple layers of coatings 24, applied by dipping for example, is one method of controlling the depth of layer 24 to fabricate the desired opening 26 size. One suitable material for the geotextile 20 with woven multifilament polyester yarn 22 with a PVC coating 24 is 10 OZ coated mesh from Snyder Manufacturing in Dover Ohio.

The lower portion 21 of the fabric 20 forming the fence 10 is from where the fence fabric 20 engages the ground 50. In the trench version of the fence shown in FIGS. 2 and 3 this portion 21 is within the trench 52, extending at least to the bottom of the trench 52, possibly also along the bottom of the trench and even up the distal side as known in the art (See prior art configuration for possible placement of the portion 21). In the trenchless version of the fence 10 shown in FIGS. 6-9 the lower portion forms a ground engaging apron 21 for the fence 10 discussed below.

An alternative woven geotextile 20 is a high strength geotextile 20 formed from high tenacity polypropylene yarn and a suitable example of such a textile may be obtained from Winfab USA. High Tenacity PP Yarn, as the name implies, is utilized for high-performance applications where tenacity is critical. The strands of the high-tenacity yarn of the textile 20 of the present invention may have 5 to 8 vertices, potentially with indentations between the vertices. The filaments' cross-section may be star-shaped. The high tenacity yarn may also be 60 to 85 CN/tex, with an elongation at break of 15% to 35%, a hot-air shrinkage of 4% to 10%, and a stretch recovery of 250 to 400 cN/tex. This high-tenacity yarn is strong, durable, and chemically resistant, and it can tolerate scorching environments that can push a traditional multifilament to its limits.

The woven geotextile 20 will preferably exhibit a tensile strength (measured in the two length and width dimensions of the fence according to ASTM D4632) of at least 300 LBS×at least 200 LBS, preferably about 370 LBS×about 250 LBS. ASTM D4632 is a grab test used to determine the breaking load (grab strength) and elongation (grab elongation) of geotextile fabrics. This ASTM D4632 standard is primarily used in quality control and acceptance testing labs comparing geotextiles of similar or identical structure. For the purpose of this application all tests identified herein will be the standards or protocols for such tests existing as of Sep. 1, 2023. Unless otherwise noted herein the term "about" herein will mean+/−3% of the stated value. The woven geotextile 20 will preferably exhibit an elongation (grab) of at least 12%×at least 12%, preferably about 15%×about 15%.

The woven geotextile 20 will preferably exhibit a trapezoidal tear strength, according to ASTM D4533, of at least 50 LBS×at least 50 LBS, preferably about 65 LBS×about 65 LBS. ASTM D4533 is a test method that determines the tear strength of geotextiles by the trapezoid procedure using a constant-rate-of-extension-type (CRE) tensile testing machine. Tear strength is the capacity of a material to withstand the tearing force required to propagate a tear after its initiation. The trapezoid tear produces tension along a reasonably defined course such that the tear propagates across the width of the specimen. The method can be used to analyze the relative tear resistance of different fabrics or different directions in the same fabric.

The woven geotextile 20 will preferably exhibit a Mullen burst strength, according to ASTM D3786, of at least 400 PSI, preferably about 450 PSI. The ASTM D3786 Bursting Strength test method describes the measurement of the resistance of textile fabrics to bursting using a hydraulic or pneumatic diaphragm bursting tester. This test method is generally applicable to a wide variety of textile products.

The woven geotextile 20 will preferably exhibit an index puncture resistance or puncture strength, according to ASTM D4833, of at least 100 LBS, preferably about 130 LBS. ASTM D4833 is used for evaluating the puncture strength of geotextiles relative to sharp objects such as rocks and stones that rest within soil.

The woven geotextile 20 will preferably exhibit an Ultraviolet light (UV) resistance (500 hours), according to ASTM D4355, of at least 70%, preferably about 80%. ASTM D4355 is a standard test method for deterioration of geotextiles by exposure to light, moisture and heat in xenon arc type apparatus. This test describes the determination of the deterioration in tensile strength of any permeable textile material employed with earth, foundation, soil, rock and so on.

The woven geotextile 20 will preferably exhibit an apparent size opening, according to ASTM D4751, of about 40 US Std, Sieve or more. ASTM D4751 covers the determination of the apparent opening size (AOS) of a geotextile either by dry-sieving glass beads through a geotextile or by using a capillary porometer. The woven geotextile 20 will preferably exhibit a permittivity and water flow rate, according to ASTM D4491, or about 1 $sec^{-1}$ and about 75 $gpm/ft^2$. ASTM D4491 provides procedures for determining the hydraulic conductivity (water permeability) of geotextiles in terms of permittivity under standard testing conditions, in the uncompressed state.

Top Drawstring 70

As noted above the present invention is directed to a woven geotextile silt fence 10 with stabilizing features. The first stabilizing feature is the inclusion of a tensioning drawstring 70 at the top of the silt fence 10. The tensioning drawstring 70 is an elastic cord at the top of the fence 10, coupled to the geotextile 20, which may be used to selectively tension, or re-tension, the silt fence 10 to remove sagging and stabilize the silt fence 10.

In operation, after use or high rain events select portions of the geotextile 10 may become stretched and sag between adjacent stakes 30. If left in a sagging condition the effective height of the silt fence 10 is reduced and the silt fence 10 may fail in heavy flow events. In other words, groundwater may more easily flow over the sagging fence 10. The drawstring 70 at the top of the fence 10 allows for easy tensioning (un-sagging) of the silt fence 10. A worker maintaining the fence 10 can merely walk along the fence 10 and at location of excessive sagging the drawstring 70 is accessed and wrapped around the stake 30 at the sagging locations one or more times to remove the sag.

A simple method of attaching the tensioning elastic cord 70 to the top of the geotextile 20 is to have a coupling strip 60 formed by a 4" wide strip of material folded over the top of the geotextile 20 (sticking up about ¾") and sewn thereto, thereby creating a tubular passageway containing the drawstring 70. Openings are provided in the coupling strip 60 at or near the stakes 30 to allow the worker to access and pull the drawstring 60 out from the inside of the tube formed by the coupling strip 60, to wrap around the stake 30 for removing of the sag in the geotextile 20. The openings in the coupling strip 60 may be provided after the attachment of the coupling strip 60 to the geotextile 20 during the assembly process. Alternatively, a line of openings spaced every two inches or so may be provided in the coupling strip 60, whereby there will always be an opening at or near a stake 30 regardless of the alignment of the coupling strip with the geotextile 20 or stakes 30 during assembly.

The coupling strip 60 also serves as a visual indicator of the top of the fence 10. If the coupling strip 60 is made from a high visibility color, distinct from the color of the geotextile 20, such as yellow or red or neon green or the like, it will add another safety feature minimizing the accidental interference with the silt fence 10 during construction activities (e.g. accidentally running over the fence 10 with construction equipment, or placing construction materials on the fence 10). The minimizing the knocking over of the silt fence 10 can also be broadly categorized as a stabilizing feature of the silt fence 10.

The coupling strip 60 as shown may also be referenced as "belting" for the geotextile 20. However, with the high strength geotextile 20 of the present invention no reinforcing belting is generally required, such that the coupling strip 60 is primarily a coupling member and a top of fence indicator herein.

The coupling strip 60 could also be replaced with a series of sewn loops along the top of the geotextile 20 to capture the elastic cord 70. In this configuration the loops and primarily the cord 70 itself would serve as the top of the fence visual indicators and each could be brightly or highly visibly colored accordingly.

Trench Engaging Stabilizing Fins

The woven geotextile silt fence 10 further includes trench engaging stabilizing fins formed by plate 40 with a bury depth indicator 42 at a top thereof, for trench applications. In this embodiment the top of the plate forms the depth indicator 42 and is at the demarcation of the lower portion 21 of the fabric 20. The stabilizing fins are easily formed by attaching a plastic rectangular plate body 40 to selective, possibly all, stakes 30 opposite the side coupled to the woven geotextile 20. The length of the plate body 40 is preferably less than the depth of a conventional silt fence trench 52 in the ground 50 and the width is less than 2 times the width of the stake 30, preferably about 1.9 times the width of the stake 30. The fins technically are the portion of the body 40 extending beyond the stake 30. This size makes the fins effective but not unwieldy or costly. The plate body 40 will engage the wall of the trench 52 during installation and the fins (the portion of the plate body extending laterally beyond the stake body 40) will add a stabilizing resistance preventing the fence 10 and stakes 30 from being pushed over and out of position by ponding water and the like on the fabric 20 or on the fence 10 as a whole.

In addition to the stabilizing fins, the top horizontal surface 42 of the plate body 40 acts as a visual bury depth indicator 42 for the stake 30. Users can quickly visually see how far to position the stake 30 in the ground 50, namely when the top surface 42 of the plate body 40 (also the top surface of the fins) is even with the top of the ground in the trench 52. As the fins and plate body 40 is less than the depth of the trench 52, the plate body 40 does not increase insertion resistance for the stake 30, and a rectangular shape for the plate body 40 is effective without causing other detrimental problems.

The stakes 30 may be made of wood or metal, but wood is deemed most cost effective. The body 40 may be made of plastic, metal or wood, but plastic may be most cost effective. The plate body 40 may be stapled, nailed or otherwise attached to the individual stakes 30. Staples 32 are shown and are shown angled to minimize tearing of the fabric 20.

Trenchless Stapled Apron Version

One of the main purposes of any silt fence is to prevent the unwanted migration of disturbed soil during construction. The trench 52 that buries the lower part 21 of the fabric 20 of the fence 10 is utilized to prevent water creating a path under the fence 10 bypassing the fabric 20. However, this installation process creates extra disturbed soil that adds to the disturbed soil load of the fence 10. More significantly, this installation requires trenching tools and labor.

FIGS. 6-9 show a trenchless installation of the fence 10 that minimizes the installation time and soil disturbance without effecting operation of the fence 10. There are several advantages to the trenchless installation shown in FIGS. 6-9. The first is the equipment needed to install the fence is merely sledgehammer, utility knife, and staple guns for staples 32 (or tool for wire ties if used) and apron staples 82, 84 and 86 (discussed below). There is no trenching equipment required or disturbed soil.

Figure 6:
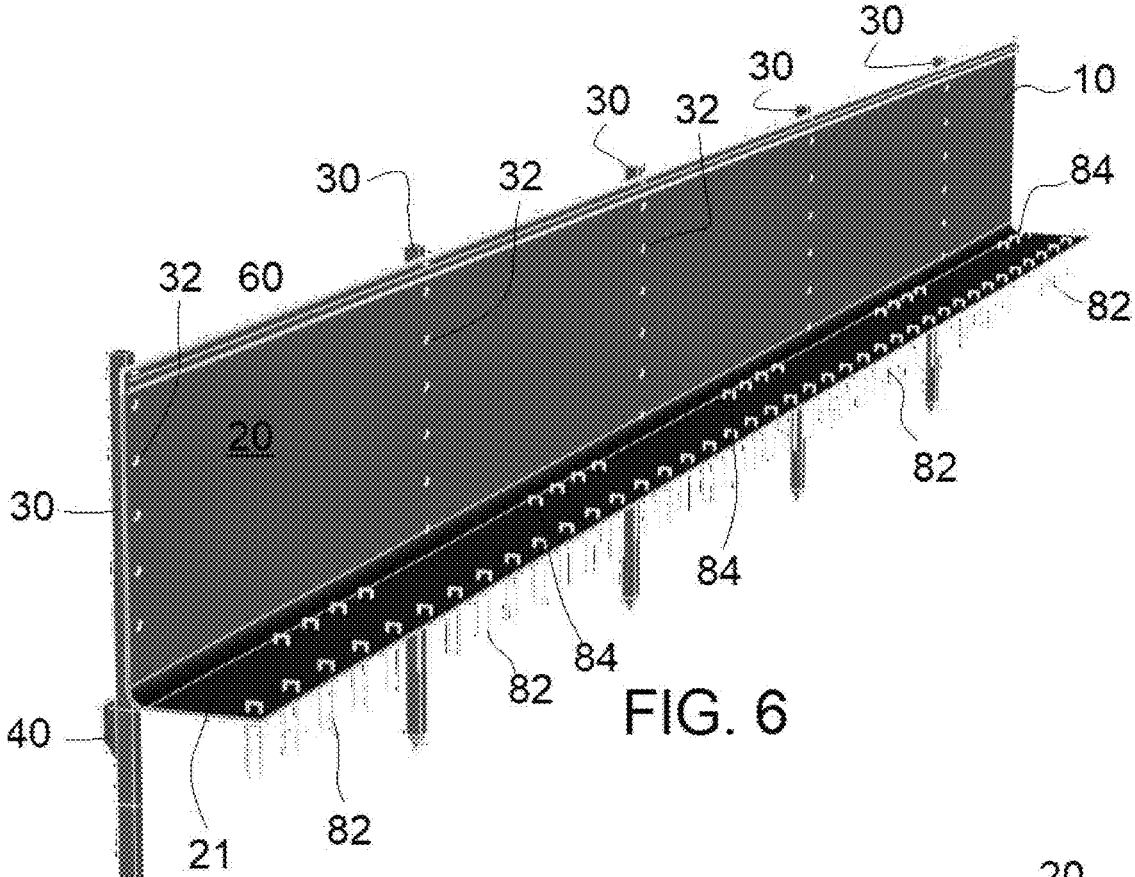
FIGS. 6 and 7 are schematic perspective views of the woven geotextile silt fence with stabilizing features according to trenchless implementations of the invention.
Figure 7:
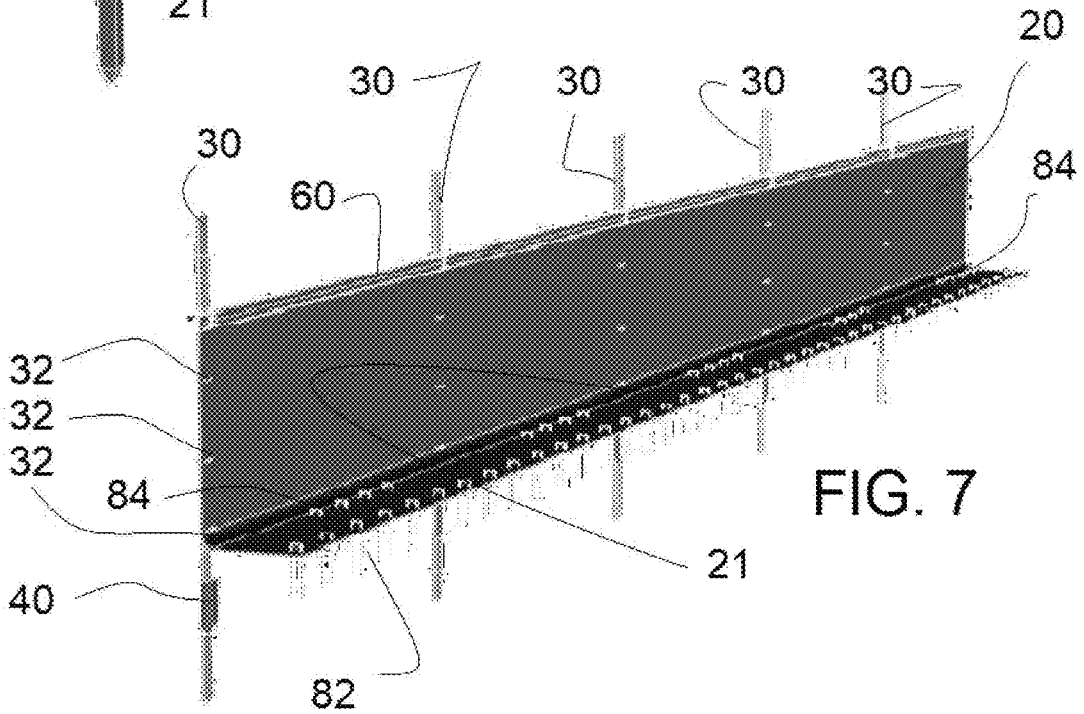

In the trenchless installation the stakes 30 are driven into the ground with a sledge hammer, and as shown in FIG. 6 the top surface 42 of the plates can also be used as a depth of driving guide. The plates 40 may be positioned without the top surface 42 forming a guide so as to be completely buried as shown in FIG. 7. In this method of installation the plate 40 preferably is beveled on the bottom as the stakes 30 will be driven into the soil 50. A preferred shape for plates 40 when the stakes are driven into the ground such as in a trenchless installation is shown in FIG. 10. The plate 40 still provides stabilizing fins for the fence 10. FIG. 6 shows preferred wooded stakes 30 with staples 32 as fasters 32, while FIG. 7 shows the use of metal t-posts forming stakes 30 and wire ties for fasteners 32.

With the stakes 30 driven into the ground 50, the lower portion 21 forms a ground engaging apron that is secured to the ground through staking elements 82, 84 and 86. The plurality of spaced wooded or metal stakes 30 are driven into the ground until the integral ground engaging apron 21 is flush with the ground 50. Preferably the staking elements 82, 84 and 86 are 1"×6" staples. The apron 21 is preferable about 12" in length. The staking elements 82, 84 and 86 include a line of staples 82 evenly spaced along the leading edge (the distal edge of the fabric 20) of the apron 21 with about 6" proving to be an effective distance. The distal end of the fabric 20 is the end spaced from the top having the tensioner 70 and coupling strip 60, which is considered the leading end of the apron 21 as it faces the upstream side of ground 50. The staking elements 82, 84 and 86 include a groupings of about four staples 84 evenly spaced along the trailing edge of the apron 21. The trailing edge of the apron 21 is spaced about 12" up from the distal end of the fabric 20, and about 6" between the staples 84 in the grouping proving to be an effective distance and the grouping being centered between the stakes 30. The staples 82 and 84 are preferably positioned perpendicular to the line of the fence 10 whereby the head of the staples extend generally perpendicular to the plane of the upper portion of the fabric 20 on the stakes 30.

Figure 9:
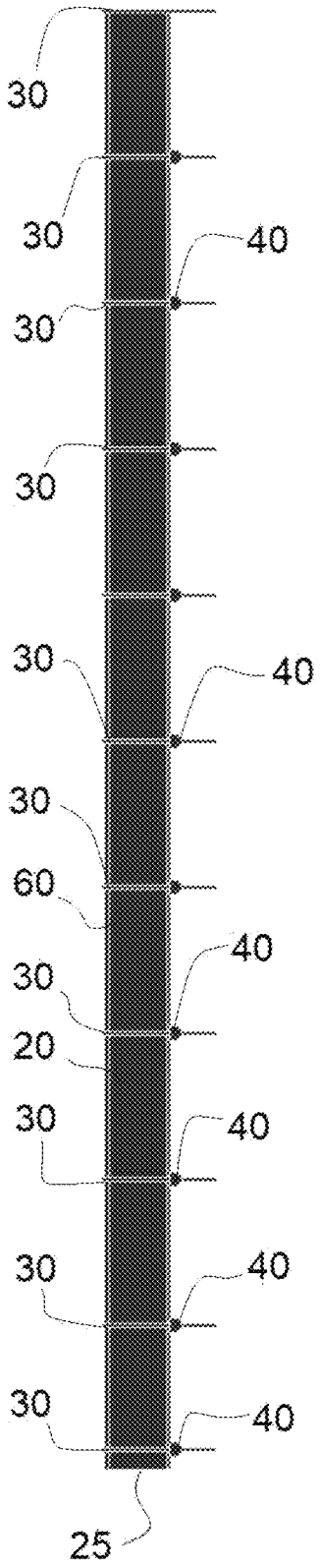
FIG. 9 is an elevated plan view of a 50' pre-staked bundle of a woven geotextile silt fence with stabilizing features and 5' stakes according to one embodiment of the invention.

The staking elements 82, 84 and 86 include a groupings staples 86 spaced along overlapping portions of apron 21. FIG. 8 is a perspective schematic view of an inside corner of the fence 10 formed with the trenchless installation method according to one embodiment of the present invention. The user cuts the apron 21 at 23 and overlaps the apron in the inside corner and adds staples 86 to hold down the overlapped portion. FIG. 9 is an elevated plan view of a 50' pre-staked bundle of a woven geotextile silt fence with stabilizing features and 5' stakes according to one embodiment of the invention showing a flap 25 on one edge of the bundle. When adding a second bundle for a fence installation the flap 25 of one section is overlapped with the other end (stake 30 without plate 40) and the a grouping of staking elements 86 will be used in the overlapped portion. Further the upper portion of the flap can be coupled to the end stake of the adjacent bundle via staples 32 (generally ¼"×1").

The fabric 20 of the fence 10 is particularly well suited for trenchless installation but this method may be applicable to other silt fences assuming they can achieve a solid engagement with the ground and prevent water from undercutting beneath the fence 10.

As noted FIG. 7 shows the use of metal t-posts forming stakes 30 and wire ties for fasteners 32. The metal posts or stakes 30 are well suited for an alternative trenchless installation in which the unbundled stakes 30 (no fabric 20 yet attached) are driven into the ground and the fabric 20 with apron 21 is later attached to the stakes 30 in situ with ties as fasteners 32 and the apron 21 is secured to the ground 50 staking elements 82, 84 and 86 as discussed above. The in situ installation may also be used with wooden stakes 30.

It is apparent that many variations to the present invention may be made without departing from the spirit and scope of the invention. The present invention is defined by the appended claims and equivalents thereto.

What is claimed is:

1. A silt fence for erosion, sediment and pollution control, the silt fence comprising:

a) a plurality of spaced wooden or metal stakes b) a single layer woven geotextile silt fence fabric having a Mullen burst strength of at least 400 PSI, having a trapezoidal tear strength of at least 50 LBS×at least 50 LBS, having an apparent size opening of at least 40 US Std Sieve, and having a tensile strength of at least 200 LBS, the single layer woven geotextile silt fence fabric comprising one of i) woven polyester yarn with a polyvinyl chloride (PVC) coating or ii) high tenacity polypropylene yarn which is 60 to 85 CN/tex; and c) at least one stabilizing feature in the form of at least one of i) a top drawstring coupled to a top edge of the woven geotextile silt fence fabric or ii) stabilizing fins coupled to at least some of the stakes.

2. The silt fence for erosion, sediment and pollution control according to claim 1, wherein the woven geotextile silt fence fabric comprises multifilament polyester yarn with a polyvinyl chloride (PVC) coating.

3. The silt fence for erosion, sediment and pollution control according to claim 2, wherein the multifilament polyester yarns are woven in a conventional fashion and then coated with the PVC coating leaving mesh openings.

4. The silt fence for erosion, sediment and pollution control according to claim 3, wherein the single layer woven geotextile silt fence fabric is 10 oz coated mesh.

5. The silt fence for erosion, sediment and pollution control according to claim 4, wherein the stabilizing features includes a top drawstring.

6. The silt fence for erosion, sediment and pollution control according to claim 3, wherein the stabilizing features includes the top drawstring coupled to the woven geotextile silt fence fabric.

7. The silt fence for erosion, sediment and pollution control according to claim 6, wherein the top drawstring is coupled to the woven geotextile silt fence fabric via a coupling strip folded over the top of the woven geotextile silt fence fabric creating a tubular passageway containing the drawstring.

8. The silt fence for erosion, sediment and pollution control according to claim 1, wherein the woven geotextile silt fence fabric comprises high tenacity polypropylene yarn which is 60 to 85 CN/tex.

9. The silt fence for erosion, sediment and pollution control according to claim 8, wherein the stabilizing features includes stabilizing fins with bury depth indicator.

10. A method of installing a silt fence for erosion, sediment and pollution control comprising the steps of:

providing a single layer geotextile silt fence fabric coupled to a plurality of stakes, the single layer geotextile silt fence fabric having a Mullen burst strength of at least 400 PSI, having a trapezoidal tear strength of at least 50 LBS×at least 50 LBS, having an apparent size opening of at least 40 US Std Sieve, and having a tensile strength of at least 200 LBS, and with a plurality of stakes including trench engaging stabilizing fins, and each stabilizing fin including a bury depth indicator;

digging a trench that is deeper than a length of the trench engaging fins;

placing the silt fence with the trench engaging stabilizing fins within the trench to the height of the bury depth indicator;

filling the trench to install the silt fence.

11. A trenchless method of installing a silt fence for erosion, sediment and pollution control, comprising the steps of:

providing a silt fence bundle comprising a plurality of spaced wooded or metal stakes and a single layer geotextile silt fence fabric coupled to the spaced wooded or metal stakes and including an integral ground engaging apron formed by the single layer geotextile silt fence fabric, the single layer geotextile silt fence fabric having a Mullen burst strength of at least 400 PSI, having a trapezoidal tear strength of at least 50 LBS×at least 50 LBS, having an apparent size opening of at least 40 US Std Sieve, and having a tensile strength of at least 200 LBS;

driving the plurality of spaced wooded or metal stakes into the ground until the integral ground engaging apron formed by the single layer geotextile silt fence fabric is flush with the ground; and staking the ground engaging apron to the ground with staking elements.

12. The trenchless method of installing a silt fence for erosion, sediment and pollution control according to claim 11, wherein the staking elements include staples.

13. The trenchless method of installing a silt fence for erosion, sediment and pollution control according to claim 11, wherein the staples include a row of staples at a leading end of the apron located at a distal end of the fabric.

14. The trenchless method of installing a silt fence for erosion, sediment and pollution control according to claim 13, wherein the staples include a groupings of staples at a trailing end of the apron.

15. The trenchless method of installing a silt fence for erosion, sediment and pollution control according to claim 14, wherein the geotextile silt fence fabric comprises a woven multifilament polyester yarn with a polyvinyl chloride (PVC) coating.

16. The trenchless method of installing a silt fence for erosion, sediment and pollution control according to claim 15, wherein the woven geotextile silt fence fabric is 10 oz coated mesh.

17. The trenchless method of installing a silt fence for erosion, sediment and pollution control according to claim 16, wherein the fence includes a top drawstring coupled to the woven geotextile silt fence fabric.

18. The trenchless method of installing a silt fence for erosion, sediment and pollution control according to claim 17, wherein the top drawstring is coupled to the woven geotextile silt fence fabric via a coupling strip folded over the top of the woven geotextile silt fence fabric creating a tubular passageway containing the drawstring.

19. The trenchless method of installing a silt fence for erosion, sediment and pollution control according to claim 14, wherein the woven geotextile silt fence fabric comprises high tenacity polypropylene yarn.

20. The trenchless method of installing a silt fence for erosion, sediment and pollution control according to claim 14, wherein a plurality of the stakes include stabilizing fins.

* * * * *